United States Patent [19]

Yazidjian

[11] 4,344,387

[45] Aug. 17, 1982

[54] DEVICE FOR SEPARATING WATER FROM STEAM AT THE VAPORIZATION VESSEL OUTLET OF A STEAM GENERATOR

[75] Inventor: Jean-Claude Yazidjian, Bougival, France

[73] Assignee: Framatome, Courbevoie, France

[21] Appl. No.: 251,850

[22] Filed: Apr. 8, 1981

[30] Foreign Application Priority Data

Apr. 18, 1980 [FR] France ..... 80 08734

[51] Int. Cl.[3] ..... F22B 1/02

[52] U.S. Cl. ..... 122/34; 122/492; 55/346

[58] Field of Search ..... 55/346–349, 55/456, 457, 337; 122/34, 488–492

[56] References Cited

U.S. PATENT DOCUMENTS 3,896,770 7/1975 Byerley et al. ..... 122/34

3,906,905 9/1975 Andrieu et al. ..... 122/34

*Primary Examiner*—Bernard Nozick

*Attorney, Agent, or Firm*—Pollock, Vande Sande & Priddy

[57] ABSTRACT

The invention relates to a device for separating water and steam at the outlet of a vaporization vessel of a recycling steam generator. The device constitutes an assembly of vertical cylindrical tubes enclosing the deflector elements enabling the separation of water and steam. These vertical separators or cyclones are grouped in sub-assemblies. Each of the cyclones of a sub-assembly is fixed to the upper portion of a common support structure, comprising from below upwards a tubular column fixed vertically on the upper portion of the vaporization vessel and a structure in the form of an upwardly flared vessel, in communication with the tubular column and with the cyclones fixed at its upper portion. The separation device is thus constructed in modular form. The invention is particularly applicable to steam generators of pressurized water nuclear reactors.

10 Claims, 4 Drawing Figures

DEVICE FOR SEPARATING WATER FROM STEAM AT THE VAPORIZATION VESSEL OUTLET OF A STEAM GENERATOR

FIELD OF THE INVENTION

The invention relates to a device for separating water and steam at the outlet of a recycling steam generator, such as a steam generator used in a nuclear power station.

DESCRIPTION OF THE PRIOR ART

The steam generators used in nuclear power stations, for example in pressurized water nuclear power stations, are generally constituted by a cylindrical pressure-resistant envelope of great height within which a secondary vessel is arranged capping a tube bundle traversed by water under pressure which constitutes the exchange fluid bringing heat from the core of the reactor to the stem generator, for the production of steam.

The supply water is introduced into the steam generator above the secondary vessel or vaporization vessel, circulates downwards outside of this vessel for entering the vaporization vessel through its lower part to come into contact with the tube bundle and be vaporized.

A mixture of water and steam richer and richer in steam circulates upwards within the vaporization vessel and emerges through the upper part of this vaporization vessel to enter the steam dome of the steam generator comprised between the upper part of the vaporization vessel and the upper part of the pressurized envelope of the of the steam generator.

In this steam dome, are placed devices for separating the water and the steam enabling the steam produced in the vaporization vessel in contact with the tubular bundle to be dried before its exit from the steam generator into the upper part of the steam dome.

These water and steam separating devices generally comprise a first stage arranged at the outlet of the vaporization vessel constituted by vertical cylindrical tubes enclosing deflectors enabling a helical motion to be given to the steam within the tubes when this water charged with steam emerges from the vaporization vessel, so that the water present in the steam is separated by centrifugal force and reincorporated with the supply water introduced into the steam generator above the vaporization vessel.

Above these primary separation devices, in the upper part of the steam dome, secondary separators or driers are also arranged, formed by means of chevron-shaped sheet metal elements for accomplishing the drying of the steam before its exit from the steam generator through a pipe connected to this generator at the uppermost part of the dome.

The cylindrical tubes with a spiral deflector also called cyclones, enable the separation of the greater part of the water entrained by the steam and the recycling of this water with the supply water introduced through a torus arranged at a level slightly below the level of the cyclones.

In normal operation, the level of the supply water in the steam generator is such that the supply torus is entirely immersed in the supply water and the cyclones emerge above this supply water.

Recent studies have shown that it was very advantageous to use cyclone separators of small diameter which permitted the performance of the separator to be increased and the space available in the steam dome to be better utilized.

For a given cross-section of this dome, higher separating performances are obtained, or again, at constant performance, it is possible to obtain a reduction in the diameter of the steam dome.

However, a reduction in the size of the cyclone separators is accompanied by an increase in their number. For example, for a steam generator of 900 MWth operating at 75 bars, about 120 to 140 separators of 200 mm diameter are necessary.

In other respects, for considerations of driving load in the recycling loop or of the water reserve in the steam generators, one may be led to fix the free level of the supply water in the steam dome at about 2 or 3 meters above the tubular bundle.

Since the cyclone separators must be above this level it is then necessary to arrange the cyclone separators at the end of the vertical inlet duct of great height connecting the separator to the vaporization vessel.

The use of separators of small diameter hence complicates the construction of the steam generator on account of the large number of inlet ducts; on the other hand, if it is desired to preserve the compact structure of the device installed in the steam dome, accessibility to the various separator devices, for example, for their maintenance or for their repair is extremely difficult. Finally, the use of a large number of tubes of small diameter and of great length is not favorable as regards the mechanical strength and necessitates a supporting structure.

It is an object of the invention to provide a device for separating water and steam at the outlet of a vaporization vessel of a recycling steam generator, such as a generator used in a nuclear power station, constituted by an assembly of vertical tubes inside of which are arranged deflector elements giving the steam a helical path enabling the separation of the water by centrifugal force, when the steam charged with water before its exit at the upper part of the generator, passes through these tubes arranged above the vaporization vessel placed in the pressurized envelope of the steam generator, within which the vaporization of water is produced, this separating device having to permit easy construction of the steam generator.

It is another object of the invention to provide such a device enabling better accessibility to the separating devices for their repair or maintenance and improved mechanical strength of the assembly constituted by the steam separating tubes.

GENERAL DESCRIPTION OF THE INVENTION

According to the invention, in such a device for separating water and steam, the cylindrical tubes or cyclones are grouped in sub-assemblies, each of the cyclones of one sub-assembly being fixed to the upper part of a support structure common to all the cyclones of the sub-assembly including, from below upwards, a tubular column fixed to the upper part of the vaporization vessel, extending the latter upwards and in communication at its inner part with the inside of this vessel and a structure in the form of an upwardly flared vessel in communication on one hand with the inner part of the column and on the other hand with the cyclones fixed to its upper part, the flared vessel and the cyclones of the corresponding sub-assembly, constituting a unit module of the separating device.

In order to understand the invention better, there will now be described, with reference to the accompanying drawings, a preferred embodiment of the separating device according to the invention, in the case of a steam generator of a pressurized water nuclear power station.

DESCRIPTION OF SOME PREFERRED EMBODIMENTS

Figure 1:
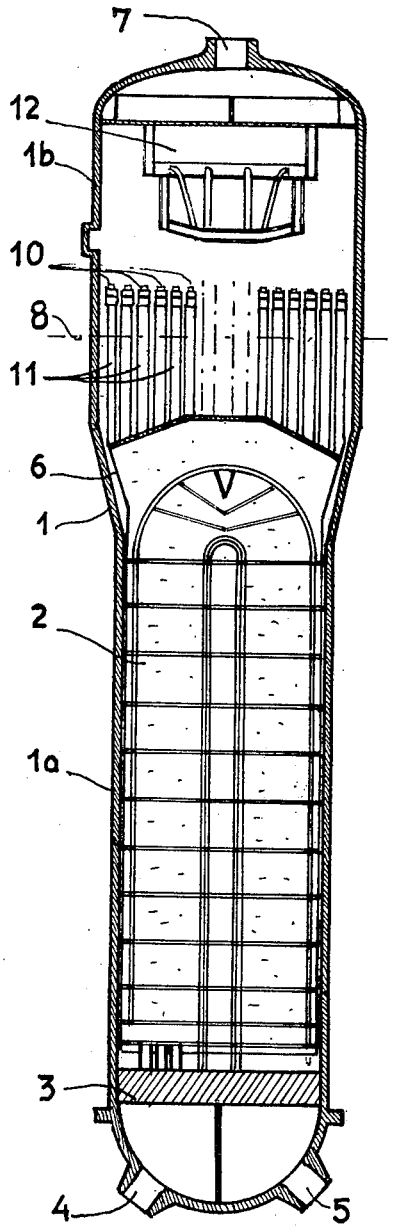
FIG. 1 shows the view in section through a vertical plane of symmetry of a steam generator including water and steam separating devices according to the prior art.

In FIG. 1, is seen a steam generator whose outer envelope 1, resistant to pressure, encloses in its lower part of the smallest diameter, a tubular bundle 2 including an assembly of bent tubes traversed by pressurized water introduced into the steam generator beneath the tubular plate 3 through an inlet pipe 4, the pressurized water traversing the tubular bundles tubes then coming back beneath the tubular plate 3 to emerge from the generator through the pipe 5.

The tube bundle 2 is surrounded up to the vicinity of its lower portion by a secondary envelope 6 constituting the vaporization vessel within which the feed water in contact with the tube bundle traversed by the pressurized water at high temperature coming from the core of the reactor, is gradually vaporized in ascending inside the vaporization vessel 6 up to its upper end, at the base of the steam dome of greater diameter than the lower portion of the steam generator.

At the highest part of the steam dome 1*b* a pipe 7 is provided enabling the exit of the steam to the turbine.

A feed water inlet device (not shown) enables the level 8 of the feed water to be kept at a certain distance above the tube bundle 2 in the steam generator, this distance being of the order of 2 to 3 meters, and beneath the cyclones 10 constituted by vertical tubes within which are arranged helical deflectors enabling the steam introduced to be made to follow a whirling path from the upper portion of the vaporization vessel 6 up to these cyclones 10 through tubular columns 11 of small diameter and of great height.

At the exit from cyclone 10, the steam has abandoned the major portion of the water entrained in emerging from the vessel 6, passes into secondary separators 12 constituted by baffles enabling more complete drying of the steam before its exit through the pipe 7.

The tubular columns 11 are fixed rigidly to the top of the vaporization vessel 6 and place the cylindrical tubes 10 constituting the cyclones in communication with the inner portion of the envelope 6 within which the feed water is vaporized.

In FIG. 1, it is seen quite clearly that the accessibility of the tubular columns 11 arranged in very large number in the vicinity of one another is poor and consequently the operations of assembly, maintenance and repair of these tubular columns are rather difficult. In the same way, the construction of this portion of the steam generator supposes a large number of operations of positioning and fastening by welding and it is very difficult to ensure sufficient mechanical strength of the assembly of these steam generators fixed at the upper end of columns of great height and small diameter.

Figure 2:
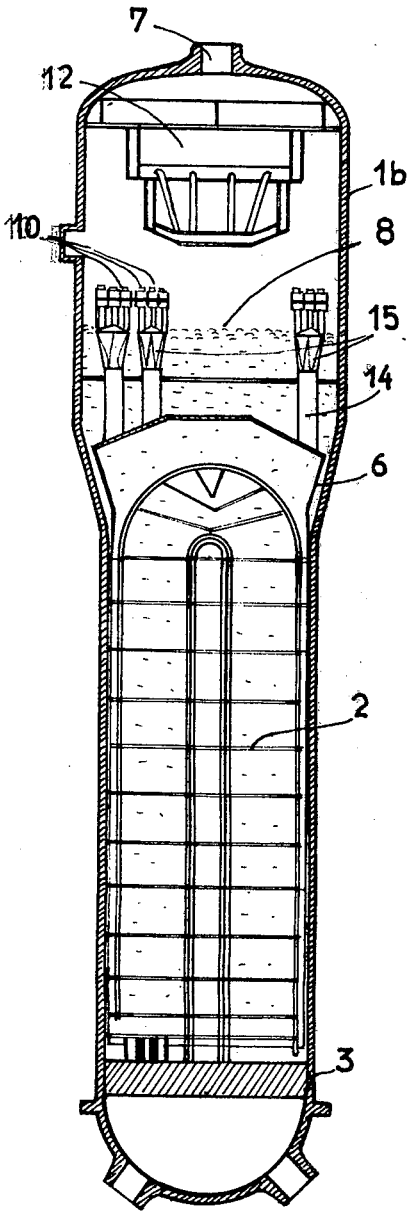
FIG. 2 shows a sectional view similar to the view of FIG. 1 of a steam generator including water-steam separators according to the invention.

In FIG. 2 is shown a steam generator wherein the various elements identical with the elements shown in FIG. 1 bear the same reference numerals.

It is seen that the cyclone separators 10 are in this embodiment corresponding to the invention fixed to the upper part of an assembly including a column 14 fixed to the upper part of the vaporization vessel 6 and a structure 15 of upwardly flared shape which will be described in more detail with reference to FIGS. 3 and 4.

Figure 3:
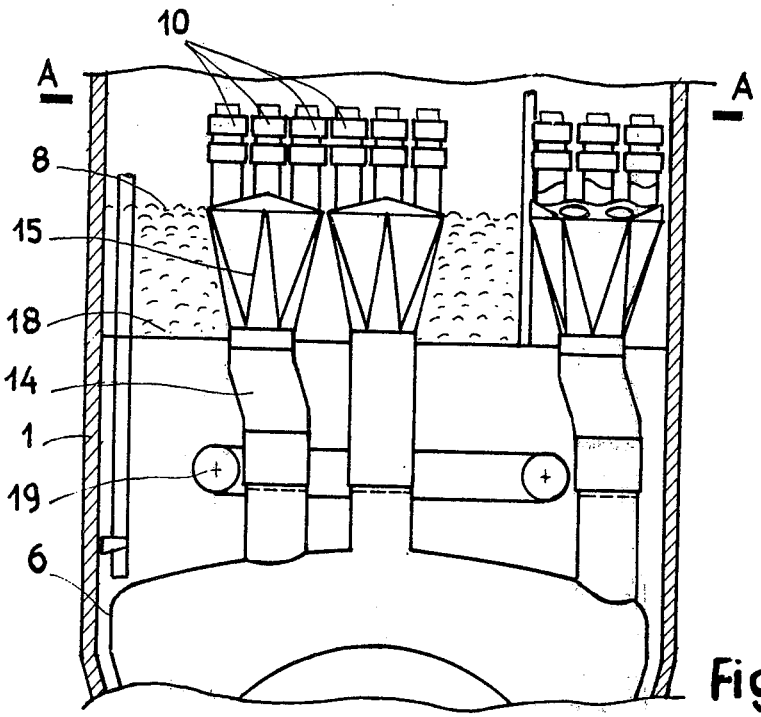
FIG. 3 shows an enlarged view of the part of the steam dome of the steam generator shown in FIG. 2, containing the water and steam separating device according to the invention.
Figure 4:
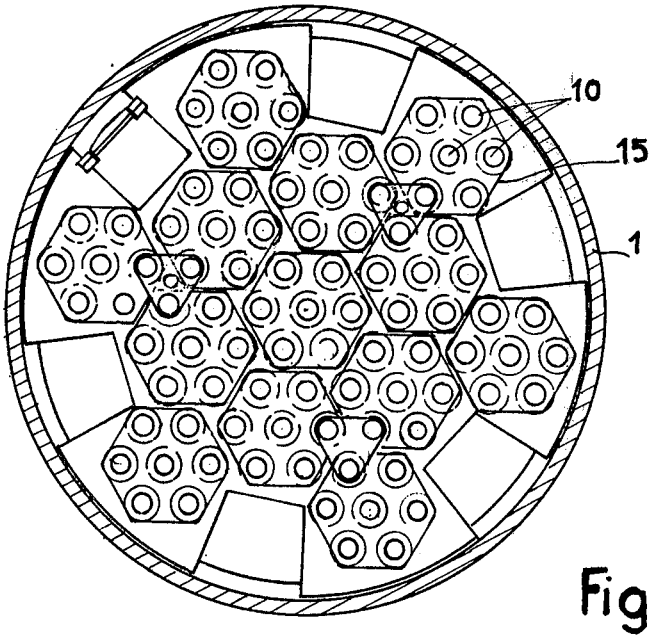
FIG. 4 shows a view along the line A—A of FIG. 3.

In FIGS. 3 and 4, it is seen that the cyclone separators 10 are grouped in sub-assemblies including 7 units fixed to the upper part of a structure 15 constituted by an upwardly flared vessel whose cross-section through a sectional plane at right angles is hexagonal.

The tubes constituting the separators are fixed by welding to the upper portion of these vessels 15 so that the inner space of the vessel 15 communicates with the inner bore of the tubes 10 enclosing the deflector devices enabling a helical path to be given to the steam.

Each vessel 15 on which 7 cyclone separators are fixed constitutes a module which can be constructed separately before assembly of the steam generator.

On the other hand, the tubular columns 14 are arranged at the upper part of the vaporization vessel 6 so that their inner bore is in communication with the inner space of this secondary vessel 6.

At the time of the final assembly of the steam generator, the lower part of each of the vessels 15 is connected with the upper part of a column 14.

The assembly of columns 14 can be held inside the steam generator by a supporting framework 18 fixed to the columns at the level of their upper part.

In this way the whole of the supporting structure of the cyclones 10 is capable of withstanding mechanical stresses encountered in the steam generator.

The cross-section of each of the columns 14 is on the other hand less than the sum of the cross-sections of the tubes 10, so that it is possible to provide very good filling of the cross-section of the steam generator by cyclone separators whilst arranging between the supporting columns 14 of the modules a sufficient space enabling, for example the positioning of the water supply torus 19 between these columns.

To permit the arrangement of the water supply torus it would be possible, for example, to cause a slight deflection in one direction and in the other of the columns in the vicinity of which the supply torus 19 passes.

In operation, the steam generator regulating system permits the water level in the generator to be kept a little below the separators 10, that is to say, at the level of the upper part of the vessels 15.

This level 8 has been shown in FIG. 3.

The fact that the cross-section of the column 14 is less than the total cross-section of the separators 10 that it supplies, does not introduce a notable additional pressure drop, since the pressure drop is principally due to the helical deflector situated inside the cyclone.

The reduction in the bulk of the column enables the accessibility, in the zone comprised between the modules constituted by the vessels 15 and separators 10 and the top of the vaporization vessel 6, to be improved.

On the other hand, the reduction in the diameter of the columns increases the cross-section available for the recycled water in the steam generator so that the total mass of water in the steam generator is increased which is beneficial for the behavior for this steam generator in the case accident.

The cross-section available for the recycled water in the steam generator being increased, the speed of descent of this water is lower which improves the degasing in the case of entrainment of steam at the exit from the separators by the recycled water.

Finally, the level measurements are more easily interpretable since the disturbing effects of the speed on the pressure take-offs are reduced enabling the checking of the level in the steam generator.

It is hence seen that the principal advantages of the device according to the invention are to enable the performance of the steam generator to be increased without modifying its dimensions, the construction of the steam generator being facilitated, due to the production in modular form of the water and steam separating devices and enabling better accessibility in the space comprised between the top of the vaporization vessel and the modules including the cyclone separators.

However the invention is not limited to the embodiment which has just been described it encompasses on the other hand all modifications.

Thus, it is possible to imagine vessels flared upwardly constituting the part of the modules on which the cyclone separators are fixed, of a shape and construction quite different from that which has been described. The cross-section of these modules can in particular be different from the hexagonal cross-section and the number of separators associated with each of the modules may be different from seven.

The position and distribution of the columns at the upper part of the vaporization vessel 6 may be quite different from that which has been shown.

The cyclone separators constituting the water and steam separating device may be associated with a secondary separating device different from a baffle drier, as in the example which has been described.

Finally, the device according to the invention is applied not only in the case of steam generators of pressurised water nuclear reactors but also in the case of other generators using an assembly of cyclones arranged vertically above a vaporization vessel, for the primary separation of the steam and the water entrained by this steam.

We claim:

1. In a device for separating water from steam at the vaporization vessel outlet of a recycling steam generator, such as a steam generator used in a nuclear power station, constituted by a set of vertical cylindrical tubes within which deflector elements are arranged, called cyclones, giving the steam a helical path enabling separation of the water by centrifugal force when the steam, charged with water before emerging from the upper part of the generator, traverses these tubes arranged above the vaporization vessel placed in the outer envelope resistant to the pressure of the steam generator in which the vaporization of the water occurs, the improvement whereby the cyclones are grouped in sub-assemblies, each of the cyclones of one sub-assembly being fixed to the upper part of the support structure common to all the cyclones of the sub-assembly, comprising from below upwards a tubular column fixed vertically to the upper part of the vaporization vessel extending the latter upwards and in communication through its inner portion with the inside of this vessel and a structure in the shape of an upwardly flared vessel, in communication on the one hand with the inner portion of the tubular column and on the other hand the cyclones fixed at its upper portion, the flared vessel and the cyclones of the corresponding sub-assembly constituting a module of the separating device.

2. Separating device according to claim 1, wherein each sub-assembly includes seven separator-cyclones.

3. Separating device according to claim 1, wherein the columns of the support structures of the cyclone sub-assemblies have a cross-section less than the sum of the cross-sections of the tubular cyclones of the corresponding sub-assembly.

4. Separating device according to claim 3, wherein each sub-assembly includes seven separator-cyclones.

5. Separating device according to claim 2, wherein the flared shaped vessels on which the cyclone separators are fixed have a hexagonal cross-section through the cross-sectional plane of the steam generator, the separator-cyclones being arranged in a hexagonal mesh pattern inside the cross-section of the steam generator.

6. Separating device according to claim 3, wherein the water supply device of the steam generator is constituted by a toric pipe arranged between certain of the support columns of the cyclone separators.

7. Separating device according to claim 6, wherein the flared shaped vessels on which the cyclone separators are fixed have a hexagonal cross-section through the cross-sectional plane of the steam generator, the separator-cyclones being arranged in a hexagonal mesh pattern inside the cross-section of the steam generator.

8. Separating device according to claim 6, wherein each sub-assembly includes seven separator-cyclones.

9. Separating device according to claim 1, wherein the flared shaped vessels on which the cyclone separators are fixed have a hexagonal cross-section through the cross-sectional plane of the steam generator, the separator-cyclones being arranged in a hexagonal mesh pattern inside the cross-section of the steam generator.

10. Separating device according to claim 9, wherein each sub-assembly includes seven separator-cyclones.

* * * * *